United States Patent [19]

Haas et al.

[11] Patent Number: 4,554,194

[45] Date of Patent: Nov. 19, 1985

[54] SELF-ADHESIVE FLOOR COVERING

[75] Inventors: Heinz Haas, Neumünster; Klaus-Dieter Struve, Aukrug, both of Fed. Rep. of Germany

[73] Assignee: Teppichwerk Neumünster GmbH, Neumünster, Fed. Rep. of Germany

[21] Appl. No.: 536,103

[22] Filed: Sep. 26, 1983

[30] Foreign Application Priority Data

Sep. 24, 1982 [DE] Fed. Rep. of Germany ..... 3235382
Aug. 4, 1983 [DE] Fed. Rep. of Germany ..... 3328165

[51] Int. Cl.[4] ..... A61F 13/02

[52] U.S. Cl. ..... 428/40; 428/95; 428/196; 428/198; 428/200

[58] Field of Search ..... 428/40, 95, 196, 198, 428/200

[56] References Cited

U.S. PATENT DOCUMENTS

| | | | |
|---|---|---|---|
| 1,990,701 | 2/1935 | Knight | 428/40 |
| 2,042,692 | 6/1936 | Wurzburg | 428/40 |
| 3,010,859 | 11/1961 | Stephens | 428/40 |
| 3,014,829 | 12/1961 | Curtin | 428/40 |
| 3,135,647 | 6/1964 | Wheeley | 428/40 |
| 3,385,743 | 5/1968 | Backberg | 428/904.4 |
| 3,408,250 | 10/1968 | Finefrock | 428/40 |
| 4,195,107 | 3/1980 | Timm | 428/40 |
| 4,349,593 | 9/1982 | Blechstein | 428/904.4 |

*Primary Examiner*—Marion E. McCamish
*Attorney, Agent, or Firm*—Peter K. Kontler

[57] ABSTRACT

The surface of a covering which is to face a floor is at least in part constituted by an adhesive capable of forming a bond. This enables the covering to be readily applied to the floor. The surface may be covered by a protective foil which prevents the covering from sticking to other objects and is removed before applying the covering to the floor.

2 Claims, 13 Drawing Figures

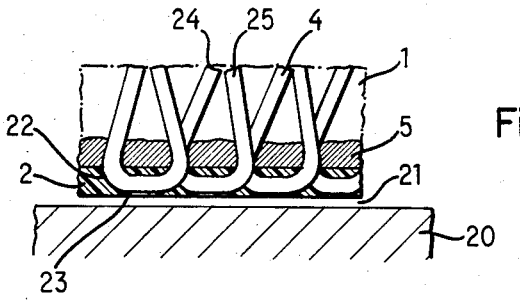
Fig. 1
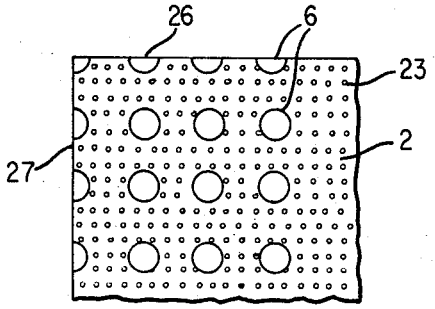
Fig. 2
Fig. 3a
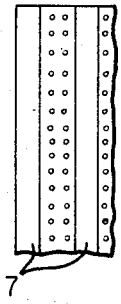
Fig. 3b
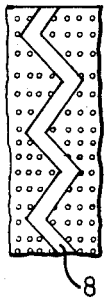
Fig. 3c
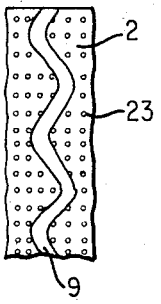
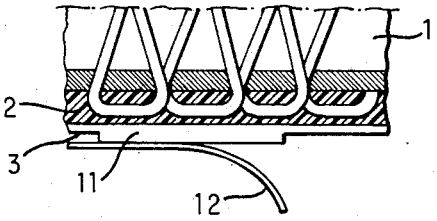
Fig. 4

SELF-ADHESIVE FLOOR COVERING

BACKGROUND OF THE INVENTION

The invention relates to a floor covering.

Floor coverings such as carpets are generally secured to the floor either by mechanical means under tension or by means of an adhesive. Since the dimensional changes of a floor covering as a function of temperature and moisture differ from those of the floor, the floor covering may become uneven despite the fact that great care is exercised in laying the floor covering. On the other hand, the application of an adhesive to the floor covering and the floor is very complicated, time-consuming and expensive. This is at least in part due to the fact that the adhesive must be applied uniformly. Moreover, the floor covering must be carefully cut so as to conform to the contour of the floor prior to adhesively securing the floor covering to the floor. The reason is that, as a rule, the floor covering is bonded to the floor so rapidly that shifting of the floor covering in order to compensate for errors in laying the same becomes impossible very soon after applying the floor covering to the floor.

In general, then, great care must be exercised and a considerable amount of time expended in order to ensure that the floor covering is properly laid.

It has become known to secure a floor covering to a floor using an adhesive band which is coated with adhesive on both sides. This, also, is complicated and requires very precise work. Furthermore, the floor covering does not always remain in uniform contact with the floor under the influence of temperature and moisture variations.

The surface to which a covering for a floor, wall or ceiling is to be applied via an adhesive must be smooth in order to obtain good adhesion over the entire contact area. In addition, many coverings comprise or consist essentially of synthetic resins which are relatively difficult to deform. This presents a disadvantage for lengths of coverings which are sold in the form of rolls. The coverings tend to retain the shape of the rolls and it is therefore extremely difficult to make the coverings conform to the configurations of the surfaces which are to be covered. The preceding considerations make it necessary to employ skilled labor in order to properly apply a covering to a surface. This is particularly true in light of the fact that a firm adhesive bond between a covering and a surface developes quite rapidly so that it is very difficult to cut the covering for the purpose of making corrections once the covering has been applied to the surface.

In certain instances, the synthetic resins contained in coverings for floors, walls and ceilings form chemical compounds with the adhesives. Not infrequently, such a chemical compound causes the synthetic resin to undergo relatively rapid aging so that the synthetic resin becomes unsightly after a fairly short time interval. Accordingly, the adhesive must be selected with great care and the selection of the adhesive should be performed by a person skilled in the art of applying coverings. If the adhesive is selected improperly, the covering may quickly become unsightly thereby necessitating premature replacement of the covering.

OBJECTS AND SUMMARY OF THE INVENTION

It is an object of the invention to provide a covering for floors, walls, ceilings and the like especially a covering for floors which may be applied in a relatively simple manner.

Another object of the invention is to provide a covering for floors, walls, ceilings and the like which may readily conform to the contour of the surface to be covered.

An additional object of the invention is to provide a covering for floors, walls, ceilings and the like which is capable of forming a good bond even with a relatively uneven surface.

A further object of the invention is to provide a covering for floors, walls, ceilings and the like which is capable of maintaining a relatively good bond with the covered surface despite temperature and moisture fluctuations.

Still another object of the invention is to provide a covering for floors, walls, ceilings and the like which makes it possible to greatly reduce the chances of premature aging.

It is also an object of the invention to provide a covering for floors, walls, ceilings and the like which is capable of being properly applied by a layman.

The preceding objects, as well as others which will become apparent as the description proceeds, are achieved by the invention.

One aspect of the invention resides in a covering for floors, walls, ceilings and the like which comprises a covering element designed to overlie a surface to be covered and having a side which is to face such surface. The side of the covering element which is to face the surface is at least in part constituted by an adhesive capable of forming a bond.

The covering element may comprise or consist essentially of a synthetic resin. According to one embodiment of the invention, the covering element comprises or consists essentially of a sheet or band of a synthetic resin.

The covering of the invention may be formable so as to permit the same to be shaped to the contour of a surface to be covered.

A covering in accordance with the invention may be applied to a surface without great difficulty regardless of whether or not the covering tends to maintain its shape. The covering may be secured to an even or uneven surface. The covering may not only be shaped to the contour of the surface which is to be covered but adheres to surfaces of virtually any character.

As indicated previously, the covering may be in the form of a band. It is particularly during the application of a band to a surface that many of the problems outlined earlier arise. The reason is that bands have large surfaces which makes it difficult for a layman to shape the band to the configuration of the surface which is to be covered. By making the side of the band which is to face the surface to be covered adhesive, the invention simplifies the problem of adapting the large surface of the band to the configuration of the surface to be covered. Even vertical surfaces, e.g. walls, may be readily covered. Bands having an adhesive side may also be secured to ceilings without difficulty.

A covering for a wall or a ceiling may be designed differently than that for a floor. The reason is that walls and ceilings are not continuously subjected to stresses such as are applied to floors, e.g. by heavy pieces of furniture or continuous pedestrian traffic.

A floor covering in accordance with the invention may be in the form of a carpet. The laying of a carpet having an adhesive side per the invention may be performed without the difficulties encountered during the laying of conventional carpets. The carpet of the invention may be adapted to the configuration of the floor to be covered. After carefully cutting the carpet to size, the adhesive side of the carpet is applied to the floor. The bonding of the carpet to the floor may be performed without additional materials such as a separate adhesive or adhesive bands which are coated with adhesive on both sides. Application of the carpet to the floor may be performed easily and rapidly without time-consuming stressing of the carpet. All that is required to lay the carpet of the invention is a suitable carpet knife for cutting the carpet to size. The carpet may be bonded to the floor by simple rolling or by treading upon the carpet. If the adhesive constituting part of the carpet is not a heat-activated or solvent-activated adhesive, it is not even necessary to apply heat or a solvent to the carpet.

An adhesive side is particularly advantageous for a three-dimensional covering, e.g. a three-dimensional carpet such as is used to carpet the interior of an automobile. Thus, substantial problems arise when it is desired to secure a three-dimensional covering to a surface. On the one hand, it is virtually impossible to tension such a covering so that connection of the covering to the surface by mechanical means may be ruled out for practical purposes. On the other hand, it is very difficult to properly apply an adhesive or a double-coated adhesive band to a three-dimensional covering.

One embodiment of the covering according to the invention comprises an adhesive layer, i.e. the adhesive side of the covering is constituted by a layer of adhesive. An adhesive layer will normally be used when the remaining part of the covering does not have adhesive properties.

Instead of an adhesive layer, it is possible for the adhesive to be incorporated in the material of the covering. For example, a carpet in accordance with the invention may comprise a plurality of fibers which define the pile of the carpet and a bonding layer which holds the fibers. One side of the bonding layer may be designed to engage a floor and an adhesive may be mixed into the bonding layer so as to make this side adhesive.

In accordance with another embodiment of the invention, the side of the covering which is to face the surface to be covered is adhesive only in selected regions or spots. This embodiment is particularly well-suited in those situations where a covering is to be applied flat over a large area and the bond between the covering and the surface need not be continuous. The adhesive regions may, for instance, define a grid having a predetermined grid spacing. Depending upon the nature of the surface to be covered and the intended use of the covering, it is further possible to provide the covering with strip-shaped adhesive regions. Such strip-shaped regions may be linear, zigzag-shaped or wave-shaped. Adhesive may also be applied to selected regions of the covering in other configurations, e.g. only the marginal regions of coverings which are sold in their final sizes.

The adhesive should be selected with a view to preventing contact between chemically incompatible materials. To this end, the nature of the surface to be covered as well as the nature of the covering should be taken into account during selection of the adhesive. Moreover, the adhesive should be selected in dependence upon the deformation characteristics of the material, e.g. the synthetic resin, constituting the remainder of the covering. For instance, if the covering comprises a synthetic resin having relatively little flexibility, a quick setting adhesive having high bonding strength is favorably used. On the other hand, if the covering comprises a synthetic resin which is relatively easily shaped, the demands made upon the adhesive are less and the bonding strength need not be as high.

A heat-activated adhesive is advantageously used. However, other types of adhesives may also be employed.

A protective foil may be arranged on the adhesive side of the covering. This foil is favorably designed so as to be resistant to sliding, that is, the foil favorably has a nonskid surface.

According to one embodiment of the invention, the protective foil is divided into discrete strips or bands. The protective strips or bands are removed only after the covering has been cut to size thereby enabling the properly dimensioned covering to be bonded to the surface which is to be covered.

The protective foil makes it possible to exercise control over when a bond is to be established between the covering and the surface being covered. In other words, a bond can be established only after the protective foil is removed from the adhesive side of the covering. If the covering operation permits, the protective foil may be continuously removed from the covering little by little so that the covering is gradually bonded to the surface being covered over small increments of area. Such slow bonding is particularly advantageous for an inflexible covering which is supplied in the form of a roll and tends to retain the shape of the roll.

Floor coverings according to the invention have been found to function satisfactorily. The initial fears that the adhesive side of a covering would not form a sufficiently strong bond with a floor proved to be unfounded. Rather, it was found that floor coverings in accordance with the invention could be laid rapidly and easily so that even a layman can apply such coverings to a floor. The floor covering of the invention does not exhibit the tendency to become loosened from the floor. Nor does a floor covering according to the invention develop ridges or waves such as are frequently observed and always feared in conventional floor coverings.

The novel features which are considered as characteristic of the invention are set forth in particular in the appended claims. The improved covering itself, however, both as to its construction and its mode of use, together with additional features and advantages thereof, will be best understood upon perusal of the following detailed description of certain specific embodiments with reference to the accompanying drawings.

BRIEF DESCRIPTION OF THE DRAWINGS

FIG. 1 is a cross-sectional view through one embodiment of a floor covering in accordance with the invention;

FIG. 2 is a plan view of the underside of another embodiment of a floor covering according to the invention;

FIGS. 3*a*–3*c* are views similar to FIG. 2 but illustrating further embodiments of the floor covering of the invention;

FIG. 4 is a cross-sectional view through an additional embodiment of a floor covering in accordance with the invention;

DESCRIPTION OF THE PREFERRED EMBODIMENTS

Figure 5:
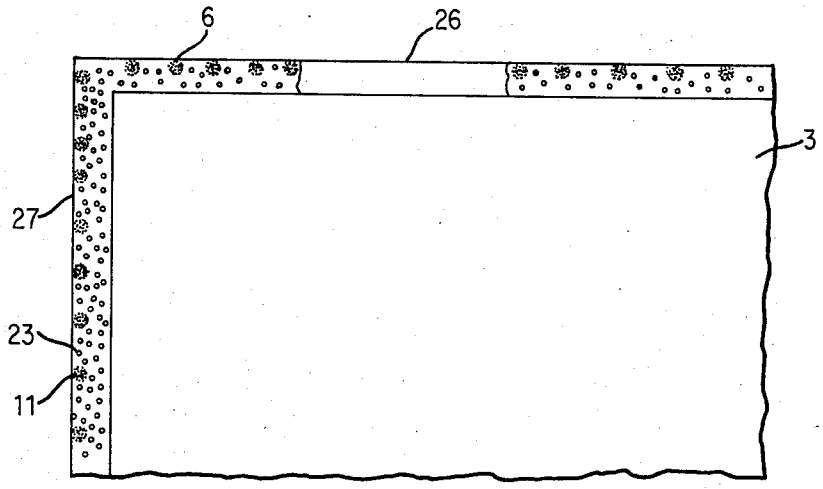
FIG. 5 is a view similar to FIG. 2 and shows yet another embodiment of a floor covering according to the invention.
Figure 6A:
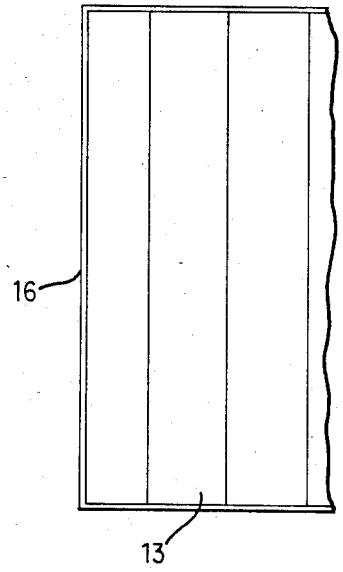
FIGS. 6*a*–6*b* are views similar to FIG. 2 but illustrating still further embodiments of the floor covering of the invention.
Figure 6B:
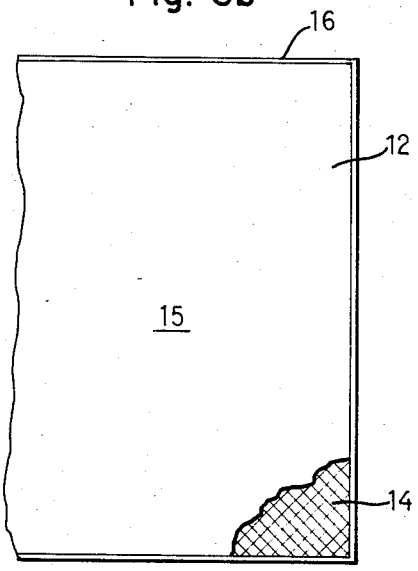

FIG. 1 shows a carpet which is to be applied to a floor 20. The carpet comprises a base layer 5, a bonding layer 2 and a plurality of fibers 4. The fibers 4 are stitched into the base layer 5 and extend into the bonding layer 2 where they define loops 22. The bonding layer 2 firmly adheres to the loops 22 and thereby retains the fibers 4 in the carpet, that is, the bonding layer 2 prevents the fibers 4 from being pulled out of the carpet. The closed ends 23 of the loops 22 protrude outwardly from the bonding layer 2 at the underside 21 of the carpet. The underside 21 of the carpet is defined by the protruding ends or protuberances 23 and the portions of the bonding layer 2 which lie between the protuberances 23.

If the upper side 1 of the carpet is to have a velour texture, each of the fibers 4 terminates in a pair of legs 24, 25 at the upper side 1 as illustrated. The carpet may also have a looped pile in which case each of the fibers 4 has a further loop at the upper side 1.

The underside 21 of the carpet is to be bonded to the floor 20. To this end, the underside 21 contains or consists of an adhesive. In the carpet of FIG. 1, the bonding layer 2 itself is composed of a material which is capable of forming an adhesive bond with the floor 20. Different regions of the bonding layer 2 may be hardened or set to different degrees by means of a hardening agent or heat prior to laying the carpet on the floor 20. For instance, it is possible to fully harden the bonding layer 2 adjacent the loops 22 so that the loops 22 are firmly bound by the bonding layer 2. In the regions between the loops 22, the bonding layer 2 remains unhardened or is only partially set thereby causing these regions to retain adhesive properties. The adhesive properties are developed when the bonding layer 2 is pressed against the floor 20.

It is also possible for the bonding layer 2 to be incapable of forming an adhesive bond with the floor 20 and to apply an adhesive material to the bonding layer 2. Such adhesive material may be applied to discrete regions of the bonding layer 2 or may be in the form of a layer which is coextensive with the bonding layer 2. The adhesive material applied to the bonding layer 2 may again be hardened or set to different degrees in different areas by means of heat or a hardening agent prior to application of the carpet 1 to the floor 20.

In some cases, it is desirable for the entire area of the underside 21 of the carpet to be capable of forming an adhesive bond with the floor 20. However, this is often unnecessary and it is sufficient for the underside 21 to be adhesive at selected regions only.

FIG. 2 illustrates one embodiment of a carpet which is adhesive at selected regions only. The carpet of FIG. 2 has a pair of intersecting edges 26 and 27 defining a corner region of the carpet. In the corner region, the underside of the carpet is provided with adhesive spots 6 which define a grid having a predetermined grid spacing. The adhesive spots 6 are capable of firmly bonding the carpet to a floor.

The undersides of the carpets of FIGS. 3*a*–3*c* are provided with a series of spaced strip-shaped adhesive regions. The carpet of FIG. 3*a* has linear adhesive strips 7 while the carpet of FIG. 3*b* has zigzag-shaped adhesive strips 8. The adhesive strips 9 on the carpet of FIG. 3*c* are wave-shaped. The adhesive strips 7–9 may extend across the entire widths or lengths of the respective carpets. Again, the adhesive strips 7–9 are capable of firmly bonding the corresponding carpets to a floor.

The shapes and distributions of the adhesive regions 6–9 shown in FIGS. 2 and 3*a*–3*c* are only exemplary. Depending upon the conditions to which a carpet is to be subjected, adhesive regions having other forms and distributions may be used.

FIG. 4 shows a carpet in which the entire underside is covered with a layer 3 of adhesive capable of forming a bond with a floor. The layer 3 is formed with spaced adhesive projections 11. The projections 11 form a relatively firm bond with a floor while the areas between the projections 11 form a relatively loose bond with the floor. If the carpet expands or contracts relative to the floor due to the effects of heat and/or moisture, length differentials between the carpet and the floor may be compensated for in the areas between the projections 11. Thus, when the carpet expands or contracts relative to the floor, the projections 11 remain firmly bonded to the floor. On the other hand, the areas of the layer 3 between the projections 11 become loosened from the floor. Accordingly, any stresses generated due to differential expansion or contraction of the floor and the carpet may be equalized while the carpet remains firmly bonded to the floor. After stress equalization has occurred, the areas of the layer 3 between the projections 11 again form bonds with the floor thereby enhancing the adhesion between the carpet and the floor.

Various types of adhesives may be used in accordance with the invention. However, a heat-activated adhesive is preferred, that is, an adhesive which develops its bonding properties upon being heated to a predetermined temperature. Heating of such an adhesive may be performed with a device which generates one or more streams of hot air. The hot air stream or streams may be used to heat the entire underside of the carpet or, if only selected regions such as the regions 6–9 of the carpet are adhesive, it is possible to heat the adhesive regions only.

Combinations of different types of adhesives may also be employed. This might, for instance, be desirable for an adhesive layer 3 such as shown in FIG. 4 which covers the entire underside of the carpet and is provided with projections 11. By way of example, the projections 11 could be constituted by a heat-activated adhesive.

The areas of the adhesive layer 3 between the projections 11 could then be formed of a permanent adhesive having a relatively low bonding strength and designed to form a bond with a floor until a predetermined shifting force is exerted on the carpet. When this predetermined shifting force is achieved, the areas of the adhesive layer 3 between the projections 11 become loosened from the floor. These areas reestablish bonds with the floor once stress equalization has occurred.

FIG. 4 shows that the underside of the carpet may be covered with a protective foil 12 which is coextensive with the underside, i.e. which covers the entire underside. The protective foil 12 preferably adheres to the underside in such a manner that it may be readily removed. To this end, a layer of a parting material may be provided between the protective foil 12 and the underside of the carpet. The protective foil 12 is selected in such a manner that at least the side of the protective foil 12 which faces away from the carpet is nonadhesive. This prevents undesired sticking of the carpet to objects. For example, if the carpet is supplied in the form of a roll, adjacent turns of the carpet are prevented from sticking to one another.

The protective foil 12 functions to greatly facilitate laying of the carpet. As long as the protective foil 12 covers the adhesive underside of the carpet, the protective foil 12 prevents the carpet from sticking to the floor. This permits the carpet to be spread on the floor and carefully cut to conform to the configuration of the latter before the carpet is bonded to the floor. After the carpet has been cut to size, the protective foil 20 is removed and the carpet is adhesively bonded to the floor.

In order to simplify removal of the protective foil 12 from the carpet, the protective foil 12 may be divided into discrete strips 13 as shown in FIG. *6a*. The strips 13 may be parallel to one another and may, for example, extend in the longitudinal direction of the carpet. After the carpet has been cut to size, the strips 13 may be removed one-by-one in accordance with the progression of the carpeting operation so that the carpet is bonded to the floor in segments.

The strips 13 may have forms and orientations different from those shown in FIG. *6a*.

FIG. *6b* illustrates that the protective foil 12 need not be divided into sections but may be of one piece. FIG. *6b* further shows that the surface 15 of the protective foil 12 which faces away from the carpet may be designed so as to inhibit sliding movement of the surface 15 on the upper surface of the carpet. This prevents shifting of the various turns of the carpet relative to one another when the carpet is rolled up. By preventing adjacent turns of a roll of the carpet from shifting relative to one another, an undesired increase in the diameter of the roll during transport may be avoided. In order to prevent relative shifting of the surface 15 and the upper surface of the carpet, the surface 15 of the protective foil 12 may be formed with a structure or design 14. The nature of the structure or design 14 should be such that the surface 15 does not slide relative to the fibers of the carpet when the latter is rolled up. By way of example, the structure or design 14 may be constituted by a roughening of the surface 15.

Instead of forming the surface 15 with a structure or design 14, it is possible to cover the surface 15 of the protective foil 12 with paper. The paper then inhibits sliding movement of the fibers of the carpet over the protective foil 12.

Advantageously, the central portion of the protective foil 12 but not the marginal portions 16 thereof are connected with the adhesive underside of the carpet. The marginal portions 16 are preferably not bonded to the underside of the carpet so that they may be readily grasped in order to remove the protective foil 12. The marginal portions 16 may be free of bonds with the underside of the carpet regardless of whether the protective foil 12 is of one piece or is divided into strips 13.

The structure or design 14 may be formed over the entire surface 15 of the protective foil 12. In many situations, however, it will suffice to provide the structure or design 14 only at discrete areas of the surface 15.

The protective foil 12 favorably consists of a material which is highly resistant to tearing. It is currently preferred for the protective foil 12 to be composed of a polyethylene. However, other synthetic resins may also be used for the protective foil 12.

Different areas of the underside of a given carpet may have different configurations of adhesive regions. This is illustrated in FIG. 5 where, by way of example, the entire central portion of the underside of the carpet is covered by a layer 3 of adhesive. On the other hand, the marginal portions of the underside adjacent the edges 26, 27 of the carpet are not entirely coated with adhesive but, instead, are provided with discrete adhesive spots 6 and/or discrete adhesive projections 11. The spots 6 and projections 11 need not be round as shown but may have any other shape.

The nature of the carpet as well as the nature of the floor must be taken into account when selecting the adhesive. The adhesive should be chemically inert with respect to the bonding layer of the carpet and with respect to the floor. In other words, the adhesive should attack neither the bonding layer of the carpet nor the floor. For instance, the bonding layer may be composed of a polyurethane. The adhesive should then be one which does not attack polyurethanes. Moreover, the adhesive should not attack the fibers of the carpet.

The adhesive may be of the type which is activated by a solvent or by water. In such an event, care must further be taken to ensure that neither the floor nor the bonding layer or fibers of the carpet are attacked by the solvent or by water.

The adhesive is preferably electrically conductive in order to prevent the build-up of electrical charge on the carpet.

Figure 7:
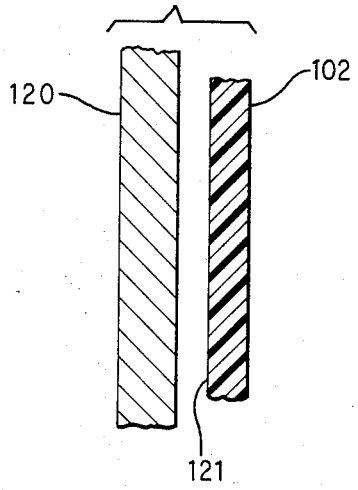
FIG. 7 is a cross-sectional view showing a covering in accordance with the invention being applied to a wall.

In FIG. 7, a vertical wall 120 is to be provided with a covering 102. The wall covering 102 is in the form of a sheet having a hidden surface 121 which is to be bonded to the wall 120 and an exposed surface which substantially parallels the hidden surface 121. The wall covering 102 consists essentially of a synthetic resin. The hidden surface 121 of the wall covering 102 is at least partially constituted by an adhesive capable of forming a bond.

In the embodiment of FIG. 7, the synthetic resin constituting the wall covering 102 is inherently adhesive at least adjacent the hidden surface 121. However, it is possible for the synthetic resin of the wall covering 102 itself to be nonadhesive and to coat the wall covering 102 with a layer of adhesive.

Figure 8:
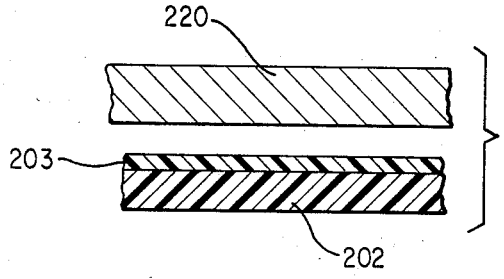
FIG. 8 is a cross-sectional view showing another embodiment of a covering according to the invention being applied to a ceiling.

FIG. 8 illustrates a covering which is to be secured to a ceiling 220. The ceiling covering comprises a sheet 202 of a synthetic resin which is coated with a layer 203 of an adhesive for the purpose of bonding the sheet 202 to the ceiling 220. The adhesive layer 203 may also be constituted by a synthetic resin. Various adhesives may be used to secure the sheet 202 to the ceiling 220. Examples are heat-activated adhesives, dispersion adhesives and solvent-containing adhesives.

It is possible to eliminate the layer 203 of adhesive. In such an event, the sheet 202 would comprise or consist of an adhesive and would be designed such that the hidden surface thereof, that is, the surface which is to face the ceiling 220, is capable of forming an adhesive bond with the ceiling 220.

The wall covering 102 and the ceiling covering 202, 203 may be supplied in the form of bands. Such bands are cut to the respective configurations of the wall 120 and the ceiling 220 so that each of the latter is properly covered.

The wall covering 102 and the ceiling covering 202, 203 may be provided with a protective covering similar to the protective foil 12. This makes it possible to facilitate the operations of cutting the wall covering 102 and the ceiling covering 202, 203 to size since the wall covering 102 and the ceiling covering 202, 203 are unable to bond to the wall 120 and the ceiling 220. Similarly, the pieces which are cut from the wall covering 102 and the ceiling covering 202, 203 are prevented from adhering to other objects. Once the wall covering 102 and the ceiling covering 202, 203 have been cut to size, the protective foil may be removed so that the wall covering 102 and the ceiling covering 202, 203 may be bonded to the wall 120 and the ceiling 220.

The hidden surfaces or sides of the sheets 102 and 202 may be adhesive in their entireties, that is, the entire areas of the hidden surfaces may be adhesive. It is further possible for only selected regions of the hidden surfaces to be adhesive. Thus, the sheets 102 and 202 may be provided with the adhesive spots 6 of FIG. 2 or the adhesive strips 7–9 of FIG. 3. Likewise, the sheets 102 and 202 may be provided with the adhesive layer 3 and projections 11 of FIG. 4. The manner in which the hidden surfaces of the sheets 102 and 202 are made adhesive depends upon the nature of the surface to be covered, the nature of the adhesive and the nature of the synthetic resin constituting the sheet 102 or 202.

The adhesives mentioned previously may also be used for the wall covering 102 and the ceiling covering 202, 203. However, heat-activated adhesives have been found to provide a particularly good bond.

Figure 9:
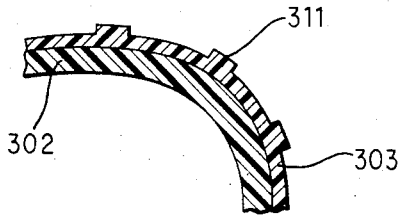
FIG. 9 is a cross-sectional view through a further embodiment of the covering of the invention.

FIG. 9 illustrates a three-dimensional covering. The three-dimensional covering includes a sheet 302 of synthetic resin which is provided with an adhesive layer 303. The adhesive layer 303, which is coextensive with the hidden surface or side of the sheet 302, has a plurality of discrete adhesive projections 311. The adhesive projections 311 form a relatively firm bond with a surface to be covered while the areas between the adhesive projections 311 form a relatively loose bond with the surface. As is the case for the adhesive projections 11 of FIG. 4, the adhesive projections 311 make it possible to compensate for expansion and contraction of the sheet 302 relative to the covered surface, e.g. due to differential thermal expansion and contraction. Thus, the relatively loose bond between the covered surface and the areas intermediate the adhesive projections 311 permits some shifting of these areas relative to the covered surface. The use of an adhesive layer such as the adhesive layer 303 is particularly advantageous for a three-dimensional covering inasmuch as it permits the covering to be well-adapted to the curved or bent configuration of the three-dimensional surface to be covered.

Figure 10:
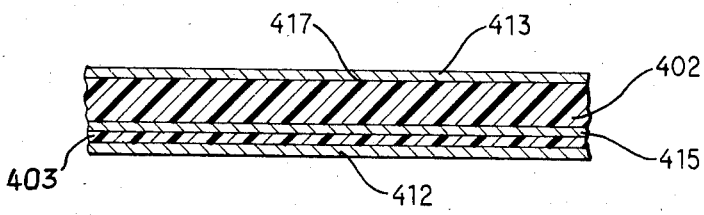
FIG. 10 is a cross-sectional view through an additional embodiment of the covering of the invention.

FIG. 10 shows a covering which comprises a sheet 402 of synthetic resin. The sheet 402 has an exposed surface or side 417 which faces away from the surface to be covered. The exposed surface 417 is provided with a wear-resistant layer 413. The wear-resistant layer 413 may, for example, be composed of a very hard but transparent material. The wear-resistant layer 413 may be separately applied to the sheet 402 or may be formed by appropriate chemical or physical treatment, e.g. glazing, of the exposed surface 417. In any event, the wear-resistant layer 413 is capable of withstanding substantial stresses. A wear-resistant layer such as the layer 413 makes a covering so resistant to bending that great difficulties in applying the covering to a surface were encountered heretofore. In most instances, double-coated adhesive bands do not provide adequate adhesion. On the other hand, when liquid adhesives are used, coverings with wear-resistant layers tend to lift off from the surface being covered and fail to form a bond with the surface. Moreover, the surface being covered must be prepared with particular care when liquid adhesives are employed in order to ensure that a uniformly good bond is formed between the covering and the surface over the entire contact area. Thus, it was heretofore necessary to very carefully plane the surface to be covered. In contrast, a covering having an adhesive side in accordance with the invention makes it unnecessary to undertake such careful preparation of the surface to be covered. The adhesive side of the covering conforms to the configuration of the surface being covered so that a good bond between the covering and the surface is obtained. It is even possible to apply the covering of the invention to an old covering, e.g. a worn out floor covering. In spite of the resistance to bending, the covering of the invention is capable of forming a good bond with an uneven surface.

Several discrete sections of a covering according to the invention may be used to cover a surface. This is useful, for example, in covering the interior of an automobile. In general, a covering consisting of discrete sections is useful where the covering frequently becomes dirty and is occasionally removed for cleaning purposes.

When a covering made up of discrete sections is removed, deformation of the sections is to be expected even if these are handled with great care. Nevertheless, due to the fact that the sections have adhesive sides in accordance with the invention, such sections may again be firmly bonded with the covered surface even though deformation has occurred.

Preferably, the individual sections of a covering for a surface are designed to be flat.

As illustrated, for instance, in FIG. 8, an adhesive layer may be directly applied to a sheet of synthetic resin. The adhesive layer should form a good bond with the sheet. To this end, the adhesive and the synthetic resin should be selected so as to be chemically compatible with one another. If it is not possible to use a synthetic resin and an adhesive which are chemically compatible with one another, an intermediate layer may be arranged between the adhesive layer and the sheet of synthetic resin. This is shown in FIG. 10 where an intermediate layer 415 is disposed between a sheet 402 of synthetic resin and an adhesive layer 403. The intermediate layer 415 is selected in such a manner that it forms a satisfactory bond both with the sheet 402 and the adhesive layer 403. In other words, the intermediate layer 415 must adhere to the sheet 402 with sufficient force to prevent separation of the intermediate layer 415 from the sheet 402. On the other hand, the intermediate layer 415 must have good adhesion to the adhesive layer 403 and must also be chemically compatible therewith. The intermediate layer 415 favorably also has high mechanical strength in order that it may transmit the forces necessary to hold the covering on the surface being covered. The intermediate layer 415 may also function to compensate for unevenness in the adjacent surface of the sheet 402 and the adjacent surface of the adhesive layer 403. To this end, the intermediate layer 415 may, for example, be rolled onto the sheet 402. The intermediate layer 415 may be fibrous and may, for instance, be in the form of a fleece. The thickness of the fleece may be of the order of 1.5 millimeters.

The adhesive layer 403 may be covered by a protective foil 412.

The sheets 102, 202, 302, 402 may, for example, be composed of a thermoplastic synthetic resin. It is further possible for these sheets 102, 202, 302, 402 to be composed of a duroplast. Particularly good surface hardness is obtained when the sheets 102, 202, 302, 402 consist of a polyvinylchloride. For this reason, polyvinylchloride coverings have found wide application. The polyvinylchloride may be mixed with other constituents, e.g. asbestos.

In addition to floors, walls and ceilings, the covering of the invention may be useful for roofs.

The following examples are intended to illustrate the invention without limiting the same.

EXAMPLE I

A carpet has a carrier or base layer constituted by a woven band of polypropylene. This band has a unit weight of 120 grams per square meter. A backing or bonding layer of foamed polyurethane is secured to the polypropylene band. The polyruethane layer has a unit weight of 530 grams per square meter. Fibers are stitched into the polypropylene band and are held by the polyurethane layer. The fiber count is 208 per square meter and the unit weight of the fibers is 600 grams per square meter. The fibers are cut so that the pile of the carpet has a cut loop texture. The combined thickness of the polypropylene band and the polyurethane layer is 5.3 millimeters while the overall height of the carpet is 10.5 millimeters. Discrete spots of adhesive defining a grid are applied to the polyurethane layer. The adhesive is a heat-activated adhesive sold under the name Helmitherm ® 42006. The adhesive is applied in an amount of 35 grams per square meter.

EXAMPLE II

A carpet has a carrier or base layer constituted by a polyester fleece. The fleece has a unit weight of 120 grams per square meter. A backing or bonding layer of unfoamed polyurethane is secured to the polyester fleece. The polyurethane layer has a unit weight of 500 grams per square meter. The fibers forming the pile of the carpet are held by the polyurethane layer which also serves as a strengthening layer. The fiber count is 215 per square meter and the unit weight of the fibers is 720 grams per square meter. The fibers are cut so that the pile of the carpet has a cut loop texture. The height of the carpet exclusing the pile is 3.9 millimeters while the overall height of the carpet is 5.8 millimeters. Discrete spots of adhesive defining a grid are applied to the polyurethane layer. The adhesive is a heat-activated adhesive sold under the name Helmitherm ® 42006. The adhesive is applied in an amount of 65 grams per square meter.

EXAMPLE III

A carpet has a carrier or base layer constituted by a woven band of polypropylene. This band has a unit weight of 120 grams per square meter. A backing or bonding layer of foamed polyurethane is secured to the polypropylene band. The polyurethane layer has a unit weight of 480 grams per square meter. Fibers are stitched into the polypropylene band and are held by the polyurethane layer. The fiber count is 145 per square meter and the unit weight of the fibers is 450 grams per square meter. The exposed ends of the fibers define loops so that the pile of the carpet has a loop texture. The combined thickness of the polypropylene band and the polyurethane layer is 2.6 millimeters while the overall height of the carpet is 7.4 millimeters. Discrete spots of adhesive defining a grid are applied to the polyurethane layer. The adhesive is a heat-activated adhesive sold under the name Helmitherm ® 42006. The adhesive is applied in an amount of 45 grams per square meter.

EXAMPLE IV

A carpet has a carrier or base layer constituted by a polyester fleece. The fleece has a unit weight of 120 grams per square meter. A backing or bonding layer of unfoamed polyurethane is secured to the polyester fleece. The polyurethane layer has a unit weight of 530 grams per square meter. The fibers forming the pile of the carpet are held by the polyurethane layer which also serves as a strengthening layer. The fiber count is 95 per square meter and the unit weight of the fibers is 650 grams per square meter. The exposed ends of the fibers define loops so that the pile of the carpet has a loop texture. The height of the carpet excluding the pile is 3.8 millimeters while the overall height of the carpet is 5.9 millimeters. Discrete spots of adhesive defining a grid are applied to the polyurethane layer. The adhesive is a heat-activated adhesive sold under the name Helmitherm ® 42006. The adhesive is applied in an amount of 60 grams per square meter.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A deformable covering, comprising (a) a first layer having a first side arranged to face toward and a second side arranged to face away from a floor, a wall, a ceiling, a roof or another support to which the covering is to be applied;

(b) an adhesive layer overlying at least in part the first side of said first layer and constituting a hotmelt which adheres to the support at room temperature in response to the application of pressure thereto by way of said first layer but is repeatedly separable from the support; and (c) a protective layer having a first side in contact with but being peelable off said adhesive layer and a second side designed to inhibit sliding movements between said protective layer and said first layer when the covering is rolled up so that the second side of the protective layer contacts the second side of the first layer.

2. The covering of claim 1, wherein said first layer comprises fibers which define said second side thereof and contact the second side of said protective layer when the covering is rolled up.

* * * * *